United States Patent [19]

Hanson

[11] 4,055,958

[45] Nov. 1, 1977

[54] SLIPFORMING METHOD AND APPARATUS FOR IN SITU LINING OF AN UPWARDLY OPEN SHAFT WITH MONOLITHIC CONCRETE

[76] Inventor: Raymond A. Hanson, P.O. Box 7400, Spokane, Wash. 99207

[21] Appl. No.: 724,655

[22] Filed: Sept. 20, 1976

[51] Int. Cl.[2] ..... E21B 33/13

[52] U.S. Cl. ..... 61/41 R; 61/63; 61/53.64; 425/59; 166/287

[58] Field of Search ..... 61/41 R, 35, 53.66, 61/53.64, 53.52, 42, 84, 85, 63; 166/287; 52/742, 127; 264/31, 32; 425/59, 63, 213; 249/10

[56] References Cited

U.S. PATENT DOCUMENTS

| | | | |
|---|---|---|---|
| 158,865 | 1/1875 | Pontez | 166/287 |
| 233,826 | 10/1880 | Wilson | 425/59 |
| 1,313,013 | 8/1919 | Polysu | 249/10 X |
| 1,867,837 | 7/1932 | Jackson | 61/42 UX |
| 2,937,429 | 5/1960 | Livingston | 425/59 |
| 3,126,959 | 3/1964 | Ortloff | 166/287 |
| 3,131,768 | 5/1964 | Chancellor et al. | 61/41 R X |
| 3,193,901 | 7/1965 | Lee et al. | 264/31 X |
| 3,434,294 | 3/1969 | Hall | 61/53.64 X |
| 3,958,637 | 5/1976 | Cobbs | 166/287 |

FOREIGN PATENT DOCUMENTS

| | | | |
|---|---|---|---|
| 1,007,184 | 5/1952 | France | 425/59 |
| 623,264 | 11/1935 | Germany | 425/59 |

*Primary Examiner*—Dennis L. Taylor

*Attorney, Agent, or Firm*—Wells, St. John & Roberts

[57] ABSTRACT

A slipform and method for lining upright shafts with monolithic concrete by pumping concrete downwardly through a "tremmie tube" to a slipform apparatus and simultaneously pulling the slipform apparatus upwardly within the shaft such that the delivered concrete is formed continuously into a monolithic lining within the shaft. The apparatus includes downwardly open outer and inner slipform members. The inner slipform or core member fits within a conical recess of the outer slipform member and includes a lower cylindrical portion for forming the open inside diameter of the lining. Concrete, in a wet condition, is delivered by the tremmie tube between the two slipform members and molded against the shaft wall. The tremmie tube is pulled upwardly from the shaft opening by a hoist mechanism that is also used during the previous drilling operation. The rate of ascent for the form members is timed in accordance with the setting time of the concrete so that the upwardly moving form members leave the formed concrete in a self-supporting state. The tremmie tube is made up of a plurality of interconnected tube sections. In the present method, individual tremmie tube sections are added at the hoist mechanism and then lowered to correspondingly lower the slipform assembly. After descending a desired distance, the steps are reversed and the tube is pulled upwardly at a relatively continuous rate while concrete is pumped down to the form members. Successive tubing lengths are removed as they clear the ground surface.

13 Claims, 7 Drawing Figures

SLIPFORMING METHOD AND APPARATUS FOR IN SITU LINING OF AN UPWARDLY OPEN SHAFT WITH MONOLITHIC CONCRETE

BACKGROUND OF THE INVENTION

The present invention is related to shaft lining forming methods and apparatus and particularly to such methods and apparatus for forming vertical or upright monolithic concrete lining in situ within mine shafts or similar excavations.

In mining operations, central mine shafts, winding shafts, blind shafts, and vertical shafts are vertical and lead downwardly to horizontal tunnels. Such shafts may extend from the earth surface vertically downward to other adjoining tunnels, or they may extend from one tunnel at a first elevation vertically to another tunnel at a different elevation. Further, vertical shafts, termed "blind shafts" extend downwardly from one tunnel to a closed bottom end. Nearly all vertical shafts must be lined with concrete or masonry to prevent the walls from collapsing and isolating the adjoining tunnels.

Usually, the upright shafts are formed by vertical boring mechanisms which are used in conjunction with a solution termed "drilling mud." As the shaft is bored, it is simmultaneously filled with the drilling mud to prevent the shaft walls from caving in. Thus, when the shaft is complete, it has been required that the drilling mud be pumped out before the lining operation may take place. Various apparatus and methods have been previously used for placing shaft linings in an upright, dry excavation.

Most presently used apparatus and methods deal with the application of monolithic concrete lining rather than the application of masonry block or brick-work lining. U.S. Pat. No. 411,981 granted to W. Davis, discloses a method of cementing cisterns or wells. The disclosed process must be performed during the excavation process since the bottom of the shaft is utilized to support the lining forming member. In carrying out the invention, an excavation is taken to a prescribed depth and a form is laid in place at the bottom of the excavation. Concrete or cement is then poured about the form and allowed to harden between the form walls and shaft. Once the concrete had hardened, the form is removed and the excavation is continued on downwardly past the ring of concrete previously formed. It is intended that this ring be utilized as both a portion of the shaft lining and as a "curbing" to hold the shaft walls intact during the remainder of the operation. It is not disclosed how the shaft walls are lined between the rings or "curbing."

U.S. Pat. No. 233,826, granted to W. Wilson on Oct. 26, 1880, discloses an apparatus for lining wells. The device is comprised of two independent form members, one for defining an exterior lining surface, and the remaining form for producing the lining interior surface. In operation, after the shaft has been excavated to a required depth, a section of cement tube is placed within the shaft and pressed against the bottom shaft end. This tube must have inside and outside diameters equal to the corresponding dimensions of the lining. Once this tube has been placed within the bottom of the shaft, the inside or core cylinder is lowered into the tube with a portion of its length extending above the top tube end. The outer cylinder is also put in place about the outside of the tube and also extends upwardly above the upper tube edge. A tubular receptacle is thereby formed into which cement or concrete may be poured and allowed to harden. Once this cement or concrete has hardened, the two form members may be slipped upwardly over the newly formed lining section to form the next successive batch of concrete poured on top of the previously poured section. In this manner, the well lining is produced in a succession of independent pours from the shaft bottom to the top.

The "inchworm" movement of the form members is commonly known as "jump forming" and is especially used in current shaft lining operations. This process has been reasonably effective. However, this procedure necessitates that the shaft be dry and drilled oversize in order to accommodate the outside form member and further requires that workers be sent down the shaft in order to effective operate the form members and spread the concrete evenly about the lining between the members. An additional problem with "jump forming," since it involves peak labor periods, is relatively low production rates.

U.S. Pat. No. 1,313,013 granted to C. Polysu on Aug. 12, 1919 discloses a method and apparatus for casing wells. This apparatus is similar to the Davis device in that the lining is formed in a downward direction from the top of the shaft and if formed while the shaft is being excavated. This particular device utilizes a boring head with a concrete slipform following behind. The lining may be poured after the boring instrument has excavated a shaft to a depth equal to the heiht of the form members. The slipform itself is simply an inner core member that forms the inside bore of the lining. Concrete is pumped downwardly to the slipform and outwardly into the area between the slipform and boring head.

As the shaft is excavated, the boring head moves downwardly and so does the slipform Concrete is pumped into the area between the slip-form and shaft as the slipform moves downwardly at a rate supposedly equal to the rate of excavation of the boring head. This rate is controlled to correspond to the setting time for the concrete so that the form lining supports itself within the shaft after disengagement from the inner core member.

At the end of the boring operation, the slipform must be left within the shaft, since the full weight of the shaft lining rests upon the lower portion thereof. The setting time of the concrete being delivered to the slipform must be timed precisely with the advancement of the boring tool. Therefore, the conditions of the soil surrounding the shaft must be very carefully considered and extremely prompt action must be taken once soil condition change. Otherwise, the lining is not formed at a correct rate. For example, if the lining were formed too quickly, the concrete could possibly not harden and could therefore fall apart once the slipform moved downwardly leaving the wet concrete to support itself. Should the boring head move too slowly, the concrete could harden within the delivery tube and halt progression of the lining at that point.

U.S. Pat. No. 3,827,344, granted to H. L. Walbro on Aug. 6, 1974, discloses a form for producing linings in mine galleries, tunnels, shafts, or the like. A slipform is used by Walbro and is pulled directly behind a tunnelling cutter. It includes a relatively short forming member that receive and forms concrete about its periphery against the tunnel walls and a series of thrust members that are utilized to support the "green" concrete until it reaches a sufficiently stable form to support itself and withstand the pressure exerted by the earth around the tunnel. The thrust members are pulled along with the forming head at a rate such that the last thrust member leaves the concrete lining surface exposed as that surface reaches a hardened condition. It is the "shutters" or reinforcing rib members that are the central subject of this patent, not the specific details of a slipform. The slipform itself is pulled along as it receives concrete in a wet state by a boring mechanism.

Other patents of general interest are U.S. Pat. No. 3,270,511 granted on Sept. 6, 1966 to E. Colly and U.S. Pat. No. 3,768,267 granted Oct. 19. 1973 to N. Chlumecky. Also, further background material may be found by referring to my U.S. Pat. No. 3,877,855 granted Apr. 15, 1975.

The present invention relates to a method and apparatus whereby a freshly bored shaft filled with drilling mud may be linded in situ with concrete in a continuous monolithic form by pumping wet concrete between longitudinally spaced members within the shaft and simultaneously pulling the form members upwardly within the shaft. The hoisting mechanism or derrick used in the drilling operation may also be used to raise and lower the slipform assembly in the shaft. An outer form member is conical in configuration and receives concrete from the lower end of a "tremie" tube. Mounted to the outer form member is an inner core member that is utilized to form the concrete about the shaft walls and define the inside bore of the finished lining. The form members are lifted upwardly from the shaft bottom as concrete is received between the form member walls. The concrete delivery rate is related to the setting time required by the concrete. The concrete is formed into self-supporting lining as the slipform leaves engagement therewith. The "tremmie tube" is guided by laterally projecting skis to center the slipform assembly in the shaft therefore, uneven areas of the shaft which have sloughed off the shaft wall may be filled by the concrete lining without the lining being dislocated from the longitudinal center. No frictional engagement of the lining or shaft wall surfaces is required for the function of moving the slipform upwardly.

SUMMARY OF THE INVENTION

The slipform apparatus and method is described for lining in situ an upright, upwardly open shaft with monolithic concrete. The apparatus includes an outer form member and a downwardly and inwardly spaced inner core form member. The outer member is downwardly open and the inner core member includes an upright wall that is spaced inwardly from the open lower end of the outer form member. A sectional tremmie tube is openly connected at a lower end to the outer core member. It supports the members and receives concrete at an upper end and directs it downwardly through the shaft to the space between the outer form member and inner core member. Concrete supply means is removably connected to the tremmie tube at its upper end for supplying fluid concrete to the tremmie tube and therefore to the form members.

The present method includes the steps of: (a) connecting a slipform, with an outer form member and complementary inwardly spaced core member to a tremmie tube; (b) lowering the slipform by the tremmie tube into a shaft; (c) pumping concrete in a plastic state through the tremmie tube to the space between the slipform and shaft wall; (d) simultaneously pulling the slipform upwardly within the shaft by the tremmie tube as concrete is received thereby; and (e) forming the received concrete into an open lining against the shaft wall as the slipform is pulled upwardly.

It is a primary object of the present invention to provide a concrete slipform for the purpose of lining upright shafts or like excavations whereby the slipform is elevationally moved within the shaft for the purpose of lining the shaft with monolithic concrete by pulling the forming members upwardly within the shaft and simultaneously delivering concrete thereto.

Another object is to provide such a device that may be operated from above ground and thereby required that no workers be situated within the shaft bore during the lining forming operation.

A still further object is to provide such an apparatus that will function to line an upwardly open shaft even though the shaft be filled with a drilling mud compound.

A yet further object is to provide such an apparatus that includes provisions for centering the forming apparatus within the shaft regarless of the shaft wall conditions thereby enabling formation of the lining along a straight line.

These and still further objects and advantages will become apparent upon reading the following detailed description which, taken with the accompanying drawings, disclose a preferred form of my invention. It should be noted however, that the following description is not intended to place restrictions upon my invention and that only the claims found at the end of the specification are to be taken as limitations on my invention.

DETAILED DESCRIPTION OF A PREFERRED EMBODIMENT

Figure 1:
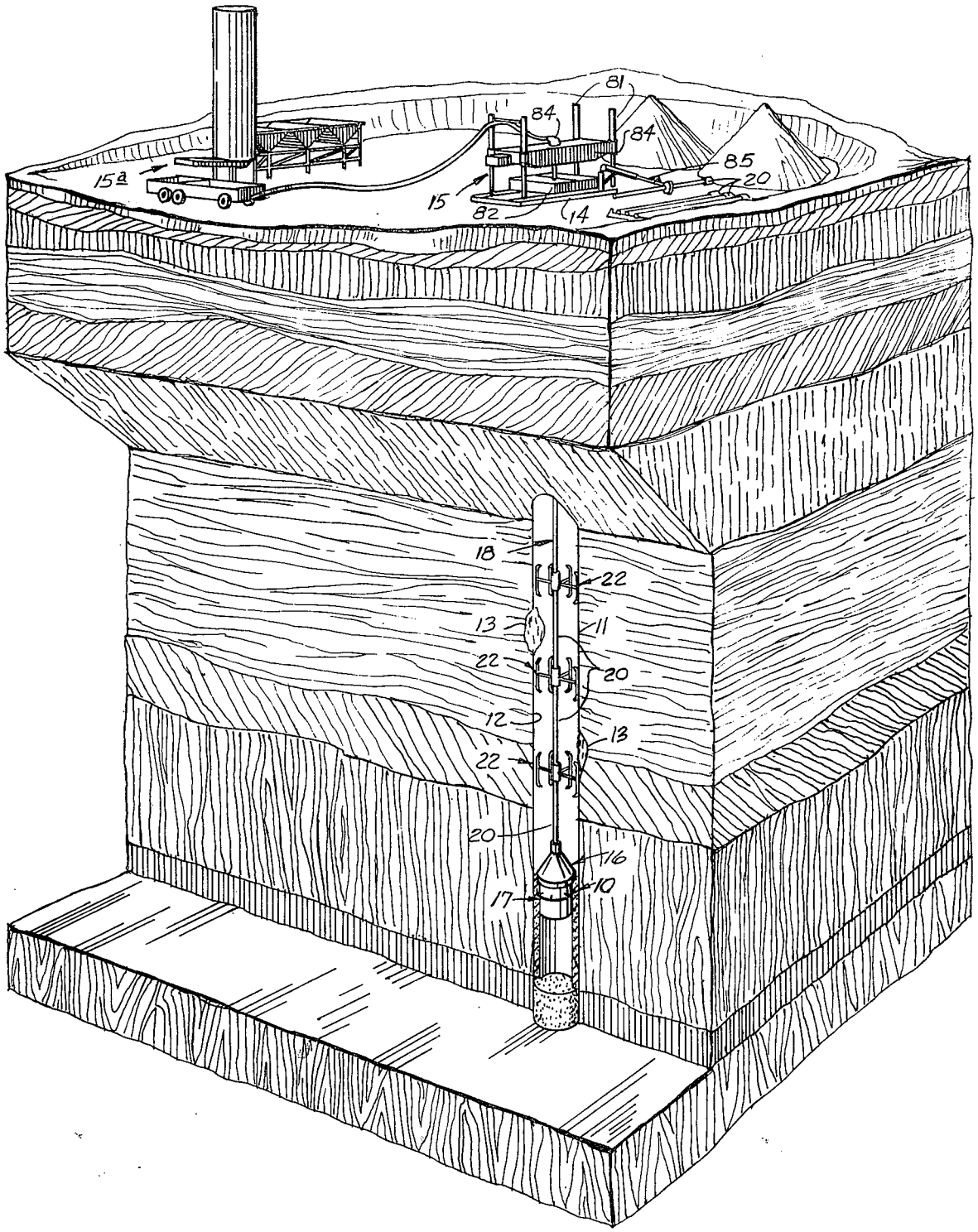
FIG. 1 is a pictorial schematic view showing the present operation forming a ventilation shaft.
Figure 3:
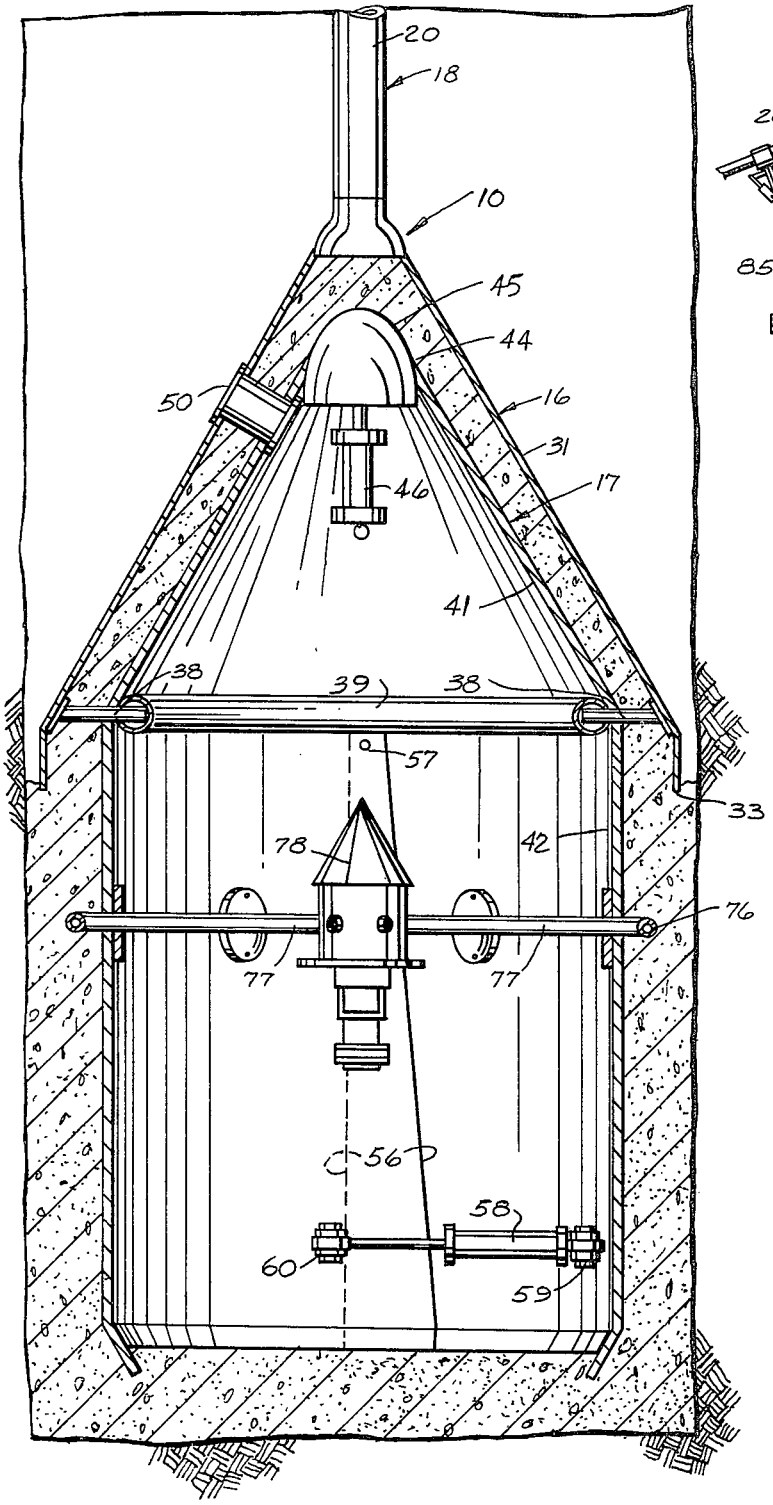
FIG. 3 is an enlarged sectional view showing the forming elements.

The apparatus of the present invention is illustrated in the accompanying drawings and is generally designated therein by the reference character 10. It is intended that the present slipform 10 be utilized within upright shafts such as that shown at 11 in FIG. 1. Such a shaft must include upright walls 12 of usually continuous cross-sectional configuration long its length. However, such shafts may have occasional irregularities or areas where the wall has sloughed off during the boring operation. Such an area is shown at 13 in FIGS. 1 and 2. Further, during the boring operation, the shaft is ordinarily filled with a watery fluid, normally called "drilling mud." This fluid is utilized to support the shaft walls after the drilling operation and is ordinarily pumped clear of the shaft after the boring procedure has been completed. However, as will be understood from the following disclosure, it is not necessary, with the present invention, to remove the drilling mud during the present lining forming operation.

Figure 2:
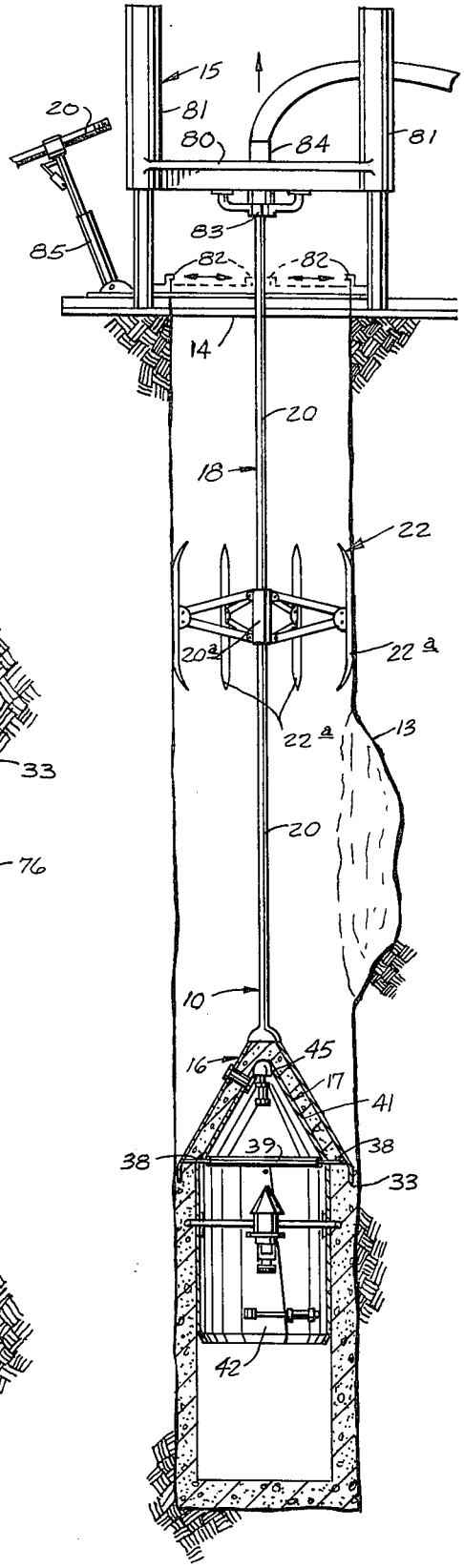
FIG. 2 is a sectional view showing the invention in operation and particularly showing details of the hoisting mechanism.
Figure 6:
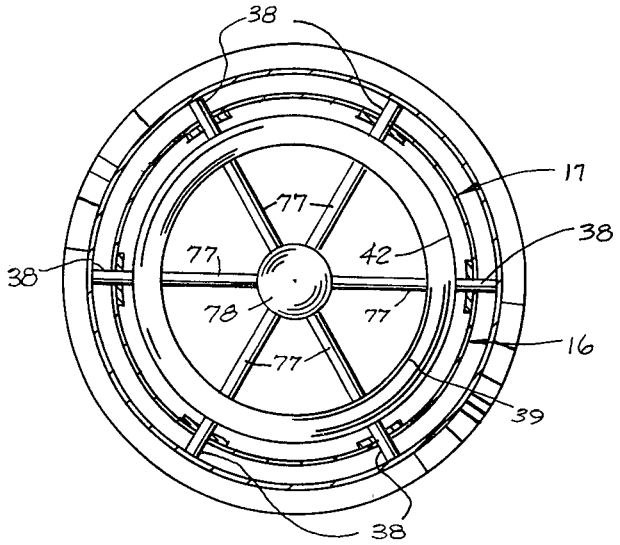
FIG. 6 is a sectional view taken along line 6—6 in FIG. 5.
Figure 7:
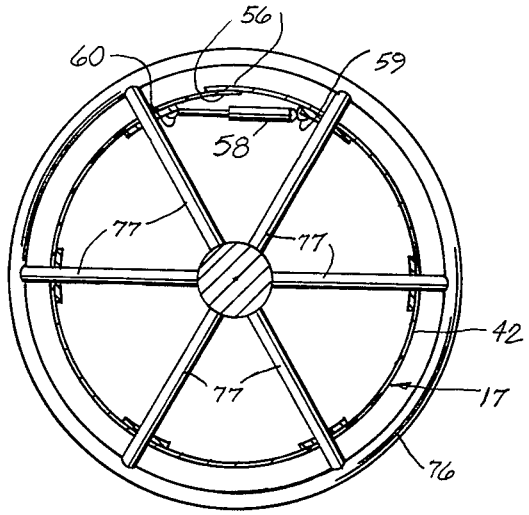
FIG. 7 is a view taken along line 7—7 in FIG. 5.
Figure 5:
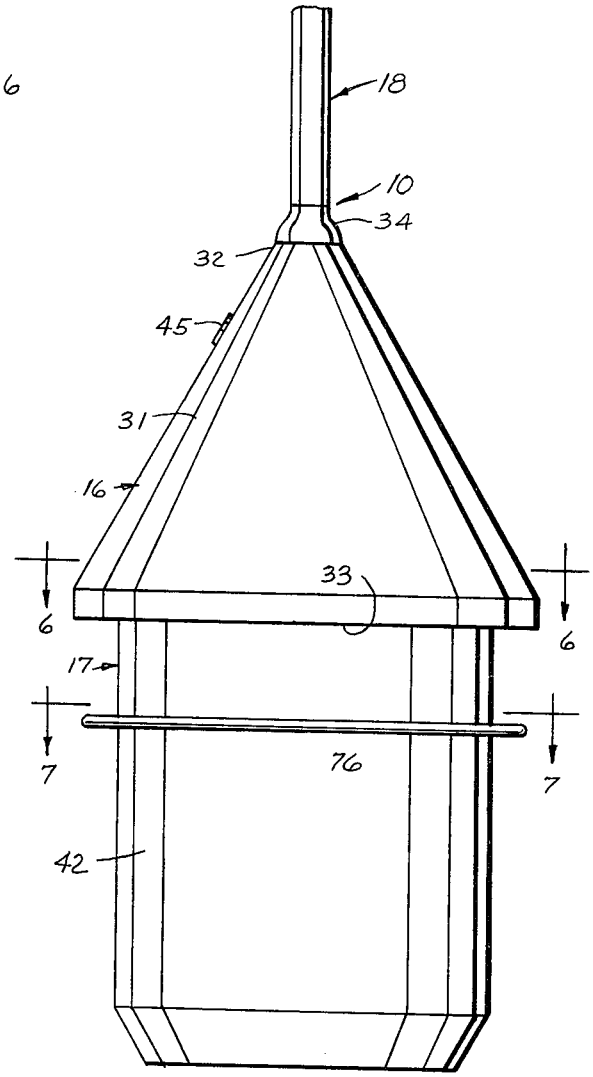
FIG. 5 is an elevational view of the forming elements.
Figure 4:
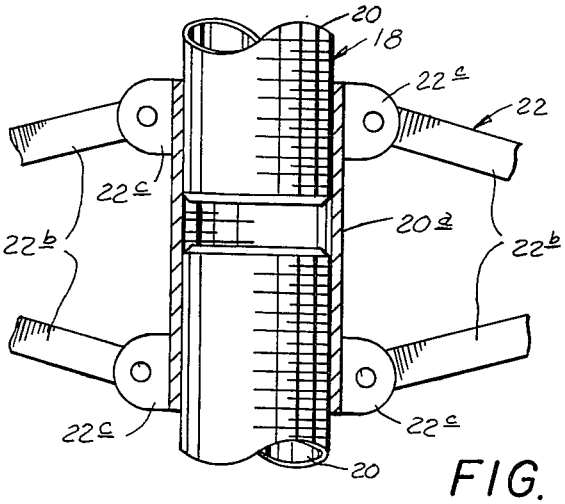
FIG. 4 is an enlarged sectional view of a typical connection along the tremmie tube.

The present slipform 10 is operated from an upper open end 14 of shaft 11. A derrick 15 is utilized at the open end 14 to control the lining operation. It is intended that the present slipform elements and associated structure by designed such that the same derrick utilized to control the shaft boring head may be utilized to similarly lift the lower slipforms within the shaft. Such a derrick is shown in FIGS. 1 and 2 and is generally referred to by the reference character 15. A concrete supply source 15*a* is shown in FIG. 1 adjacent to the derrick 15 for providing a continuous supply of wet concrete to the slipform when in operation.

The slipform includes an outer form member 16 and an inner core member 17. An elongated delivery pipe, commonly termed "tremmie tube" 18 is connected to member 16 for directing concrete from the supply source to the members 16 abd 17. Members 16 and 17 are suspended within the shaft by tube 18 and derrick 15.

The tremmie tube 18 is comprised of a plurality of releasably interconnected tube sections 20. Each tube section 20 includes a fitting 20*a* at one end thereof that releasably receives a complementary end of an adjoining tube. A guide means 22 may be provided at each of the connections 20*a* to assure that the form members 16 and 17 are held within the shaft and moved along its longitudinal center axis regardless of slough areas. Each guide means 22 is simply comprised of a number of ski shaped elements 22*a* that are releasably connected by legs 22*b* to projecting ears on 22*c* on each coupling 20*a.* The guiding elements may be added to the tremmie tube as it is assembled and lowered into the shaft and removed as the tube is pulled upwardly during the forming operation.

The outer form member 16 is shown in substantial detail in FIGS. 3 and 5 through 7. As shown, the outer form member 16 is substantially conical in configuration. It includes a continuous conical wall surface 31 extends from a reduced upper end 32 to a lower peripheral edge 33. Lower edge 33 is substantially complementary to the crosssectional configuration of shaft 11 (substantially cylindrical). The upper end 32 is connected directly to the tremmie tube 18 at 34.

The conical outer member 16 serves to direct concrete from the tremmie tube outwardly toward the shaft walls. The edge 33 is spaced slightly inward of the shaft walls to allow free vertical movement of the slipform assembly within the shaft. In the lining forming operation the slipform assembly is pulled at a rate corresponding to the reception of wet concrete and its drying time. There is little opportunity for the level of the wet concrete to rise any more than slightly above edge 33.

The inner core member 17 is mounted to the outer member 16 by a number of radial brace members 38. These members 38 extend between member 17 and outer member 16. A circular base ring 39 may be provided to rigidly connect the brace members and more securely mount the core member 17 to the form member 16.

The inner core member 17 includes an upper conical member 41 that is complementary to and spaced inwardly of the conical wall surface 31 of outer member 16. The inner conical member 41 is joined at a lower edge thereof to a lower cylindrical member 42. It is the cylindrical member 42 that defines the inside cross-sectional configuration of the concrete lining 19.

A feature of the present apparatus is the construction of cylindrical wall section 42 and its function in relation to the present method and apparatus. The cylindrical member 42 extends along an axis that is coaxial to the upright center line of shaft 11. The cylinder in constructed of a single sheet of material having longitudinal side edges 56 that overlap one another. Edges 56 are joined together at an upper end by a pivot pin 57. A hydraulic ram cylinder 58 connects the overlapping edges at a lower end of member 42. A bracket 59 mounts one end of ram 58 to one side of the overlapping joint while a bracket 60 mounts the remaining end of ram 58 to the cylinder 42 on the opposite side of the joint. Ram 58 may be selectively operated to extend or retract and thereby expand or contract the effective cross-sectional diameter of the member 42 at its lower end.

Contraction of the ram 58 results in corresponding contraction of the cylindrical member 42 to facilitate disengagement of the cylinder with the concrete lining 19. Thus, if the concrete around cylindrical portion 42 were to prematurely harden, the ram 58 could be contracted to disengage the surface from the lining and allow the slipform to be lifted from engagement with the hardened lining.

An upper open end 44 of conical member 41 includes a dump plug assembly 45. The assembly 45 includes a dump cylinder 46 attached to a bullet-shaped plug that fits within opening 44. The dump cylinder 46 may be selectively operated to lower the plug from engagement with the opening and thereby allow concrete to fall into the central opening area without being passed between the form members to become part of the lining 19. The plug assembly is provided as a precaution to enable evacuation of undesirable material sent through the tremmie tube 18 rather than delivering such material between the form and core members to become an integral part of the lining 19.

If the shaft 10 is full of drilling mud, a vent must be provided between the area below slipform 10 and the area immediately above to enable relatively free vertical movement of the slipform elements within the shaft. Therefore, vent tube 50 is provided that interconnects the form member 16 and core member 17. The tube 50 is open at both ends to allow communication between the shaft areas divided by the members 16 and 17.

It has been found that the radial brace members will segregate aggregate from the wet cement mixture and thereby leave vertical lines in the finished lining that will crack under excessive stress. To prevent this separation, a vibration consolidator is located directly downstream of the braces and at a position where the concrete is still in a relatively plastic state during the process of forming lining 19. The consolidator includes a circular ring 76 that circumscribes the area between core member 17 and the shaft wall. Vibration is imparted to ring 76 through radial spokes 77. The spokes 77, in turn, are operatively connected to a central vibration motor 78. The ring will vibrate at a fixed frequency in response to motor 78. As the slipform moves upwardly, the vibrating ring will move through the wet concrete consolidating the aggregate and liquefying the wet concrete so it will mold itself against the shaft wall.

Ordinarily, no reinforcement is utilized in conjunction with monolithic linings formed by a slipform, however, recently developed reinforcing fibers (either glass or metal) may be pumped along with the concrete to provide structural reinforcement to the finished lining.

The inclusion of such reinforcing fibers will not adversely effect operation of the vibrator mechanism or lining forming operation.

The hoist mechanism 15 generally shown in FIGS. 1 and 2 includes a movable frame 80 that is mounted to upright jacks 82 for vertical movement at the shaft opening. Two clamp assemblies 82 and 83 are provided to successively clamp and hold the tremmie tube at alternate times during the raising and lowering operations. A lower elevationally stationary tube clamp 82 is situated on a hoist mechanism directly adjacent the shaft opening. The remaining clamp 83 is located directly above clamp 82 and is mounted to the movable frame 80. A releasable connector 84 is situated upwardly adjacent the upper movable clamp 83 on frame 80 to alternately connect and disconnect the concrete supply source to the tremmie tube 18. Also supplied is a section handling boom 85 that may be operated to add sections to the tremmie tube length or to remove sections from the length as the form is being pulled upwardly.

From the above technical disclosure, the present method for lining upright shafts with a monolithic concrete lining may now be understood.

After the initial boring operation in which the shaft is formed by lowering a rotating boring tool downwardly from a hoist mechanism 15, the boring and associated drill stems are removed from the shaft leaving the shaft relatively free of obstruction and (usually) filled with the "drilling mud."

In initiating the first step of the present method, the slipform 10 is connected to the tremmie tube 18 and lowered to the bottom end of the shaft. This step is accomplished uilizing the hoist mechanism 15 and section handling boom 85.

After initially placing the slipform 19 into the shaft, sections 20 of the tremmie tube are added in succession to the upper end in a fashion similar to the manner by which the drill stem is formed, by interconnecting short shaft sections. Each successive section 20 is moved by the handling boom 85 into contact with the preceding section 20 and is threaded or otherwise engaged therewith. During this time the preceding section (and remainder of the slipform depending therefrom) is held by the stationary lower tube clamp 82 with its upward connector member **20*a* exposed above the ground surface. The additional tube section is secured to the preceding section and the upper movable tube clamp 83 is actuated to clamp the upper end of that section. A releasable guide 22 may be added to the joined sections at this point. Then, the lower clamp is released and the mechanism frame 80 is lowered, allowing the newly added section to move downwardly into the shaft, bringing the section's upper end elevationally adjacent to the stationary clamp 82.**

As the upper tube end reaches this elevation the frame is stopped and the stationary clamp 82 is actuated to close on the upper tube end. The movable clamp then releases to allow the frame to return to an elevated position awaiting reception of the next successive tube section.

The tremmie tube is extended in this manner to a length nearly equal to the depth of the shaft in order to bring the slipform members to a position adjacent the shaft bottom as shown in FIG. 2. Once the members reach this position, the concrete supply means is actuated and a "rabbit" or slidable plug is placed in the tremmie tube to move ahead of concrete being pumped downwardly through the tube to the form members. The rabbit will evacuate the tremmie tube of drilling mud. Of course, the rabbit can not serve to evacuate the entire area between members 16 and 17, nor the area between the cylindrical wall 42 and the shaft walls 12. Therefore, the hoist mechanism 15 is not operated to initiate upward movement of the slipform until sufficient time has passed for the pumped concrete to completely evacuate the lining area of drilling mud. This is done simply by utilizing the concrete itself as the "rabbit" to push the drilling mud downwardly and into the central portion of the cylindrical wall section 42. This allows a slight buildup of concrete along a bottom of the shaft which may be later removed or utilized as a sump for the shaft.

Once it becomes reasonable to assume that the concrete has completely displaced the drilling mud from the lining area, the derrick or hoist mechanism 15 may be operated to initiate a continuous upward movement of the slipform members to begin the forming operation. This is done by utilizing the hoist mechanism to pull upwardly on the tremmie tube. Thus, an operation is performed directly opposite to that described for lowering the slipform to the bottom of the shaft.

The rate of ascent for the slipform is determined by controlling the jack mechanisms 81 to lift the tremmie tube at a rate in close correspondence to the rate of delivery of concrete to the form members. This rate is also assciated with the drying or set time of the concrete so that once the cylindrical wall portion 42 leaves engagement with the lining, the concrete at that level has attained a "set" condition wherein it is self-supporting. The drilling mud greatly assists the present method by providing support to the not yet fully hardened walls of the lining while the slipform is moved upwardly. Free exchange of the drilling mud from above the slipform members to below is permitted through the valve 50.

The hoist is operated in the upward movement of the slipform during the forming operation to pull the tremmie tube upwardly in increments substantially equal to the length of the successive tube sections 20. Once a section 20 has been pulled above ground, the guide mechanisms 22 are removed and the lower stationary clamp 82 is operated to grip and hold the next lower tube section (and slipforms) in place while the exposed section is disconnected from the concrete supply and is removed to an area along side by the handling boom 85. The end of the next successive tube section is then reconnected to the concrete supply source and the upward movement is again initiated as the hoist frame 80 is lowered and the clamp 83 is engaged with the upper section end. The stationary clamp is released and the jacks are operated to lift that section along with the remaining sections and slipform upwardly at the prescribed rate as determined by the concrete setting time and flow rate. The successive removed sections are flushed with water and cleaned before being stored for future use.

As the slipform members reach a slough area 13 such as that shown in FIGS. 1 and 2, the rate of ascent is slowed while the flow remains at the same rate in order for the concrete to completely fill the sloughed area as the slipform moves upwardly. Usually the sloughed areas are known at the time of drilling and can be accounted for by detecting the elevation of the slough area and metering and ascent of the slipform. Additionally, there may be sensor mechanisms (not shown) provided on the outer form member to detect or indicate the distance from the shaft center to the shaft walls. If this distance is substantially increased, an automatic control (also not shown) could be actuated to correspondingly slow the upward movement of the slipform or to increase the flow of concrete until the sloughed area is filled in. The guide mechanisms 22 along the entire length of the tremmie tube serve to hold the slipform member at the longitudinal center of the shaft. Thus the shaft lining is maintained coaxial with the intended longitudinal upright axis of the shaft.

The upward movement of the form members is not entirely continuous. There exists a momentary delay of the upward movement each time a tube section is removed and the movable clamp is lowered to connect to the next successive section. The amount of time required to perform these operations is relatively insignificant and does not hamper the construction of the lining. However, should a breakdown occur wherein the forming members 16 and 17 would necessarily be held stationary for a long period of time, there are provisions in the cylinder 58 and overlapping sides of cylindrical section 42 to allow disengagement of the slipform with the lining.

For example, if the concrete supply mechanism sustained a breakdown, the slipform would likely sit stationary for a relatively extended period of time. To prevent the form from being anchored by the setting concrete, the cylinder 58 is retracted to reduce the outside diameter of cylindrical wall 42 and enable disengagement of the slipform from the shaft lining.

Once the concrete lining process has been stopped for a period of time, it is necessary to again flush the tremmie tube and area between members 16 and 17 of the drilling mud to start with a fresh, solid joint between the hardened, previously formed lining and the new continuation thereof. In accomplishing this, the form is lowered to the top end of the hardened lining and another rabbit is sent through the tremmie tube. The delivered concrete is then pumped for a period of time sufficient to flush the concrete delivery area fcompletely of the drilling mud. If it is not possible to entirely flush the area of drilling mud, a weakened area will result at the juncture of the old lining with the new. This may be repaired once the lining has been completed and the drilling mud pumped from the shaft core.

The lining operation is completed as the slipform members reach the top of the shaft 14.

It may have become obvious that various changes and modifications may be made in method and apparatus disclosed in the foregoing description. It was intended, however, that this description only set forth an example of a preferred form of the invention. Only the following claims are to be taken as restrictions upon the invention.

What I claim is:

1. In a slipform assembly for lining in situ an upright upwardly open vertical walled shaft with monolithic concrete, a combination comprising:

a conical outer form member having an open lower end;

an upwardly closed inner core member mounted to the outer form member;

said inner core member having an upright wall spaced inwardly from the open lower end of the outer form member;

sectioned tremmie tube means openly connected at a lower end to the outer core member for supporting the outer form and inner core members within the shaft and for receiving concrete at an upper end and directing the concrete downwardly between the outer form and inner core members;

guide means on the tremmie tube for centering the outer form and inner core members in a shaft; and concrete supply means removably connected to the tremmie tube at its upper end for supplying fluid concrete to the tremmie tube.

2. The combination as defined by claim 1 wherein the form member and core member are complementary in cross section to the shaft with the outer form member having a conical wall surface tapering from a lower circular edge adjacent the shaft wall upwardly to a reduced concrete inlet port end adapted to be connected to the tremmie tube; wherein the inner core member includes an inner conical surface inwardly adjacent and parallel to the outer conical surface; and wherein the upright core wall of the inner core member is connected to the inner conical surface at a lower peripherial edge thereof.

3. The combination as defined by claim 2 wherein the upright core wall is cylindrical and is formed of a single sheet of material with overlapping longitudinal edges and wherein means is included for moving the longitudinal edges in opposite lateral directions to selectively change the core wall diameter.

4. The combination as defined by claim 1 further including an open ventilator duct joining the inner core and outer form members.

5. The combination as defined by claim 1 wherein the guide means is comprised of ski assemblies mounted to the tremmie tube at longitudinally spaced locations thereon.

6. The slipform as defined by claim 5 wherein the tremmie tube is comprised of releasable interconnected and wherein the ski assemblies are removably mountable to the sections.

7. The combination as defined by claim 1 further comprising a concrete dump means on the core form member for dumping concrete directly from the area between the outer form and core member to the area enclosed by the upright wall of the core member.

8. The combination as defined by claim 1 further comprising vibrator means extending between the inner core and outer form member.

9. A method of lining in-situ an upwardly open shaft with monolighic concrete, comprising the steps of:

connecting a tremie tube to a slipform having an outer conical shaped form member complementary to the cross-sectional configuration of the shaft at a lower peripheral edge thereof and an inwardly spaced conical core member;

lowering the slipform and the tremie tube into the shaft;

pumping concrete in a plastic state through the tremie tube to the slipform between the outer conical shaped form member and the inwardly spaced conical core member;

directing the pumped concrete downward and outward in a conical direction and discharging the concrete from the lower peripheral edge of the slipform to the space between the shaft wall and the slipform;

simultaneously pulling the slipform upwardly within the shaft by the tremie tube as the concrete sets; and forming the received concrete into an open lining against the shaft wall as the slipform is pulled upwardly.

10. The method as recited by claim 9 wherein the tremmie tube is made up of a multiplicity of interconnected sections and is lengthened as the slipform is lowered into the shaft by successively connecting additional sections to the slipform and lowering them into the shaft; and wherein the slipform is raised by pulling the tremmie tube upwardly in increments and successively disconnecting and removing the tube sections.

11. The method as recited by claim 9 further comprising the step of vibrating the concrete as it is formed against the shaft wall.

12. The method as recited by claim 9 further comprising the step of centering the slipform within the shaft while it is pulled upwardly.

13. The method set out by claim 9 comprising the further step of providing means for selectively disengaging the core form member from the lining by contracting the form to a cross-sectional dimension less than the complementary cross-sectional dimension of the lining.

* * * * *